United States Patent [19]

Davis

[11] Patent Number: 4,981,221

[45] Date of Patent: Jan. 1, 1991

[54] FOOTWEAR RACK

[76] Inventor: Michael J. Davis, 5912 Valerian Blvd., Orlando, Fla. 32819

[21] Appl. No.: 468,464

[22] Filed: Jan. 22, 1990

[51] Int. Cl.[5] ..... A47F 7/00

[52] U.S. Cl. ..... 211/37; 211/189; 211/194

[58] Field of Search ..... 211/37, 34, 194, 188, 211/189; 248/188.8, 188.9

[56] References Cited

U.S. PATENT DOCUMENTS

| | | | |
|---|---|---|---|
| D. 165,942 | 8/1951 | Stein . | |
| 1,401,356 | 12/1921 | Parchert . | |
| 1,450,948 | 4/1923 | Glidden . | |
| 1,703,190 | 2/1929 | Glidden . | |
| 2,205,817 | 6/1940 | Kramb . | |
| 2,654,487 | 10/1953 | Degener | 211/188 |
| 2,815,862 | 12/1957 | Einhorn . | |
| 2,845,182 | 7/1958 | Atkinson . | |
| 2,901,117 | 8/1959 | Plocki et al. | 211/38 |
| 4,463,853 | 8/1984 | Licari et al. . | |
| 4,754,885 | 7/1988 | Rich | 248/188.9 X |
| 4,915,238 | 4/1990 | Cassel | 211/37 |

*Primary Examiner*—Robert W. Gibson, Jr.
*Attorney, Agent, or Firm*—Warren L. Franz

[57] ABSTRACT

A footwear rack has an open box-like framework with four upright corner posts respectively joined by upper and lower longitudinally and laterally extending horizontal cross-members. Each cross-member has two rows of inverted U-shaped hangers for supporting shoes in parallel rows, internally and externally at each elevation about the whole periphery of the rack. Adjacent inside corner loops at the junctions of lateral and longitudinal cross-members are indented away from the corner to accommodate the sides of neighboring shoes mounted on the perpendicular cross-members. Inserts placed in hollow tubular posts permit identical racks to be stacked, one above the other.

20 Claims, 2 Drawing Sheets

FOOTWEAR RACK

This invention relates to an improved rack for supporting footwear and the like in a closely-packed, compact arrangement.

BACKGROUND OF THE INVENTION

A rack of the type to which the present invention relates is shown in Licari et al. U.S. Pat. No. 4,463,853. Such a rack provides for the convenient storage of shoes, sandals, sneakers, slippers and similar footwear disposed in general vertical orientation about the periphery of an open box-like skeletal framework which has four corner posts interconnected by two levels of respectively laterally and longitudinally extending cross-members. Each cross-member includes a plurality of hangers axially spaced therealong and comprising upwardly projecting, inverted U-shaped elements onto which the internal toe-receiving portions of the footwear can be placed, to mount the footwear either interiorly or exteriorly of the rack framework.

It is known in such racks to form the hangers associated with a particular cross-member by bending a length of wire or rod (hereafter "wire") into a corrugated succession of U-shaped loops, with alternate loops normally extending vertically upwardly and other connecting loops between the alternate loops normally extending downwardly and having a permanent connection by welding or otherwise to the cross-member. See, e.g., Einhorn U.S. Patent No. 2,815,862 and Atkinson U.S. Pat. No. 2,845,182. It is also known in the context of industrial racks, which are used for transferring shoes from one part of a shoe factory to another, to provide casters on the bases of the corner posts. See, e.g., Parchert U.S. Pat. No. 1,401,356 and Glidden U.S. Pat. Nos. 1,450,948 and 1,703,190.

For non-industrial applications, there has been an emphasis on making racks that are increasingly lightweight and less expensive. The ostensible reason for this is the belief that if racks can be produced at very low cost, their mass marketability through discount retail chains acceptance by home consumers will be improved. As a consequence, cheaper materials and less rugged construction have been employed, with an accompanying sacrifice in sturdiness and durability. Extensive use has been made, for example, of unitary, molded plastics and inexpensive bent wire frames. Also, cheap snap fittings have been used in place of welding and screw/bolt fastenings. The result is that currently available units for the home market are unattractive to consumers because they are readily subject to breakage, bending, warping, and the like.

Conventional racks of the type to which the present invention relates are also deficient in that they tend to take up too much space per shoe. This is especially a problem in the home market where a principal motivation for purchase is the avoidance of clutter and conservation of closet space. Racks such as those shown in the Einhorn '862 and Atkinson '182 patents have low shoe density, with hangers being arranged in parallel laterally extending rows, one row per cross-member, and no provision being made for hanging shoes on longitudinally extending members. Although the Licari et al. '853 arrangement improves on such low shoe density arrangements by permitting shoes to be hung about the whole periphery of the rack, even Licari provides a capability of hanging only one row of shoes on each cross-member. And, while the truncated pyramidal shape of the Licari rack enables nesting for sale display purposes, the inwardly slanted nature of the corner posts prevents stacking of the Licari units corner post base-to-corner post top, one on top of the other, in order to multiply the number of available hanging stations. The industrial designs of the Glidden units provide for two staggered rows of shoes per cross-member, yet the same space conservation motivation for close packing is lacking in the shoe factory environment, so the shoes are arranged in general horizontal, spacing-wasting projecting orientation.

SUMMARY OF THE INVENTION

It is an object of the invention to provide an improved rack for supporting footwear and similar hollowed clothing accessories in a closely-packed, compact arrangement. It is a further object of the invention to provide an improved footwear rack having a sturdy and durable, space-saving framework which is suitable for home, as well as commercial use.

In accordance with the invention, a rack is provided having an open box-like skeletal framework including corner posts and upper and lower cross-members respectively extending laterally and longitudinally between the posts. Each cross-member is accommodated with first and second pluralities of hanger elements dimensioned, configured and adapted to support footwear in general vertical orientation, both exteriorly and interiorly of the rack, in parallel rows on the same cross-member. The hangers are preferably configured as inverted U-shaped loops that respectively project upwardly from opposite sides of each cross-member into the toe-receiving hollows of the footwear. The loops of each row are optionally angled slightly away from vertical to facilitate the attachment of shoes. As described in greater detail below, the inside rows of loops at inside corners of the rack are advantageously indented to avoid interference between footwear placed in neighboring corner positions interiorly of the rack.

A footwear rack in accordance with the invention permits a neat, high density footwear organization, suitable for both home and commercial usage, with a high degree of frame stability and durability. Preferred configurations of the rack, discussed below, provide flexibility and versatility, including the capability to substitute different longitudinal cross-members to vary the size of the unit or multiply shoe racking capacity by adding identical units, stacked post base-to-post top, one above the other.

While the detailed description below deals primarily with usage of the rack for supporting shoes and similar footwear, it is to be understood that the rack is also useful for hanging other footwear, such as socks, handwear, such as gloves and mittens, and other hollowed articles having outwardly opening internal cavities. The open nature of the rack also makes it convenient for uses such as warming boots, gloves, scarves, hats, etc., over a warm air register in colder climates, or for drying bathing hats, suits, towels, etc., in hot climates.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

The principles of the invention are illustrated, by way of example, embodied in the form of a rack 10 (FIG. 1) suitable for supporting footwear, such as shoes 12, 14 (FIGS. 2 and 3), in a closely packed, compact arrangement.

Figure 1:
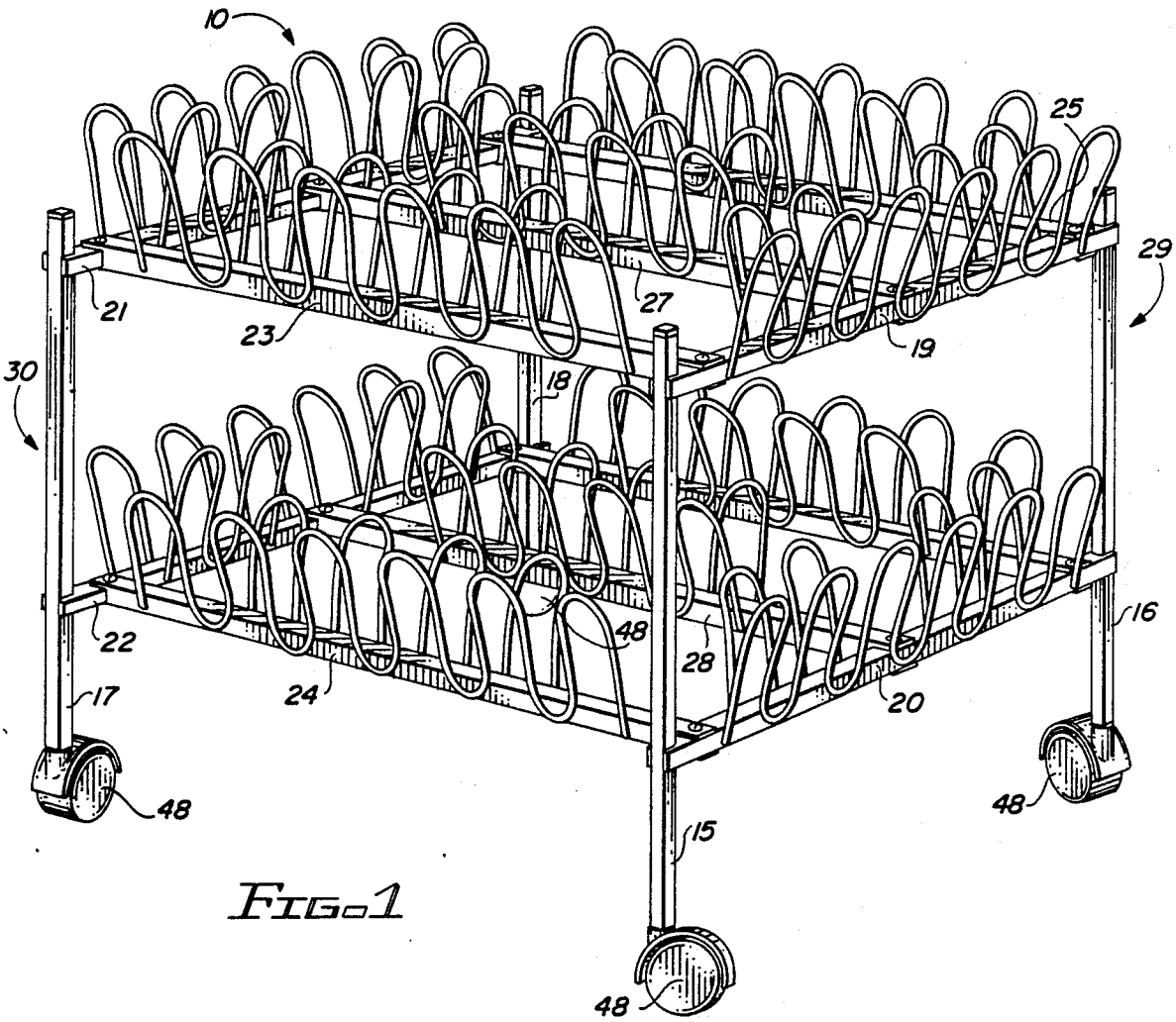
FIG. 1 is perspective view of a rack in accordance with the invention.
Figure 4:
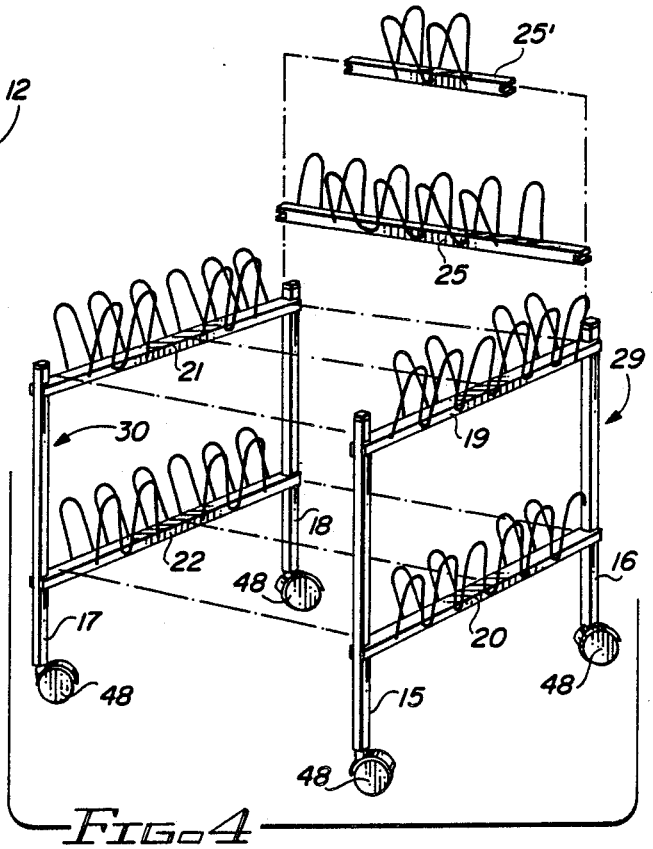
FIG. 4 is a schematic view useful in understanding the assembly and size modification of the rack of FIG. 1.

As shown in FIG. 1, the rack framework includes four upright corner posts 15, 16, 17, 18 joined at upper and lower elevations by respectively laterally and longitudinally extending, upper and lower horizontal cross-members 19, 20, 21, 22, 23, 24, 25, 26, 27, 28. Posts 15, 16 are laterally-spaced and interconnected by upper and lower laterally-extending, elongated cross-members 19, 20. Opposing posts 17, 18 are laterally-spaced and interconnected by upper and lower, elongated cross-members 21, 22. The posts 15, 16 and cross-members 19, 20 are preferably positioned in the same plane and may be welded or otherwise permanently attached to form a right end frame 29 of rectangular configuration. Likewise, the posts 17, 18 and cross-members 21, 22 are made coplanar and attached to form a left end frame 30, positioned in longitudinally-spaced, opposing relationship to the right end frame 29 (FIG. 4). End frames 29 and 30 are preferably identical. The different end frames 29, 30 are interconnected by upper and lower elongated cross-members 23, 24, 25, 26, 27, 28 respectively extending longitudinally at different elevations between like parts of the end frames 29, 30. Cross-members 23, 24 extend from points proximal post 15 to points proximal post 17; cross-members 25, 26 extend from points proximal post 16 to points proximal post 18; and cross-members 27, 28 extend from central points on cross-members 19, 20 to central points on cross-members 21, 22.

The longitudinal cross-members 23, 25, 27 are preferably positioned parallel to each other in an upper elevation, common horizontal plane which is coplanar with the upper lateral cross-members 19, 21; and longitudinal cross-members 24, 26, 28 are likewise preferably positioned parallel to each other in a lower elevation, common horizontal plane which is coplanar with the lower lateral cross-members 20, 22. This gives the framework of the rack 10, as depicted, an open rectangular box-like configuration.

In accordance with the invention, the cross-members 19–28 are each provided with first and second rows 31, 32 of hanger elements 34, 35 running in transversely-displaced, opposing positions, axially of the cross-members 19–28. The hangers 34, 35 preferably take the form of axially-spaced, inverted U-shaped upwardly projecting elements and are dimensioned, configured and adapted to support footwear 12, 14 in general vertical orientation, as shown (see FIGS. 2 and 3). In a preferred construction, the posts 15–18 and cross-members 19–28 are made of hollow, rectangular cross-sectioned tubular steel material and the hangers 34, 35 are formed by lengths of wire or rod bent into a corrugated succession of U-shaped loops, with alternating ones of said loops 36 (FIG. 2) projecting upwardly and other connecting ones of said loops 37 between the alternating loops 36 normally extending downwardly and being permanently attached, as by spot welding connections 38 to the cross-members 19–28.

As already stated, each cross-member 19–28 has two rows 31, 32 of hangers. One row 31 of hangers 34 (FIG. 2) of the cross-members 19–26 is dimensioned, configured and adapted to hang footwear 12, 14 exteriorly of the framework of rack 10, i.e., on the outer or non-facing sides of the cross-members 19–26. The other row 32 of hangers 35 is dimensioned, configured and adapted to hang the shoes 12, 14 interiorly of the rack 10, i.e., in gaps between facing sides of the cross-members 19–26. The rows 31, 32 of hangers 34, 35 of the central, longitudinally extending cross-members 27, 28 are dimensioned, configured and adapted to respectively hang shoes interiorly of the rack on both sides of the cross-members 27, 28, those hung on hangers 34 being hung with heels facing the cross-members 23, 24, and those hung on hangers 35 being hung with heels facing the cross-members 25, 26. In this manner, shoes 12, 14 can be supported both interiorly and exteriorly at each elevation around the entire periphery of the rack framework, two rows of shoes on each cross-member. The shoes 12, 14 are mounted in general vertical orientation (see FIGS. 2 and 3) by extending the loops 36 into the toe-receiving hollows of the shoes.

Figure 3:
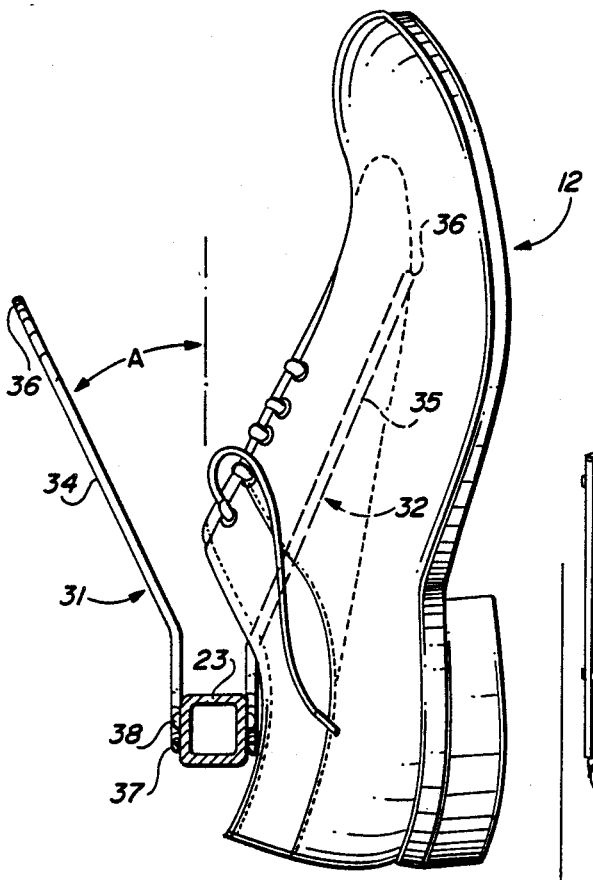
FIG. 3 is a section view taken along the line 3—3 of FIG. 2.

To facilitate the mounting and withdrawal of footwear 12, 14, the rows 31, 32 of hangers 34, 35 of each cross-member 19–28 may be respectively angled outwardly of the rack 10 by an angle "A" less than 45° from vertical, as shown in FIG. 3. The depicted cross-member 23 in FIG. 3 has the loops 36 of the outside row 31 of hangers 34 bent outwardly by an angle of 25°–30°. from vertical. The loops 36 of the opposing hangers 35 of the inside row 32 of the same cross-member 23 are shown bent inwardly by an equal, but opposite, 25°–30° angle.

To avoid interference at the inside corners of the rack 10 between shoes 12, 14 mounted in neighboring interior positions (shown in phantom in FIG. 2) on adjacent perpendicular cross-members 21, 23 of the same level, while hangers 34 extend for almost the whole length of the perpendicular cross-members 21, 23, the hangers 35 of the internal rows 31 of the cross-member 21, 23 are preferably axially indented away from the corner. This is done to provide additional room internally at the corners to accommodate the neighboring shoes 12, 14 which are placed on the endmost loops 36 of the hangers 35 of the cross-members 21, 23. Similar provision is made at the corresponding perpendicular abutting portions of the other cross-members 19, 20, 22, 24–28.

The embodiment of rack 10 shown in FIG. 1 permits a close stacking arrangement of 48 pairs of shoes in an approximately square, open box-like framework having equal lateral, longitudinal and height dimensions of 22 inches. Each cross-member 19–26 has an outside hanger row 31 of six loops 36 and an inside row 32 of four loops 36 each. Each cross-member 27, 28 has two opposing rows of four loops each. The end loops 36 of the inside row 32 of the cross-members 19–26 and the end loops of both rows of the cross-members 27, 28 are inset by a distance "D" (FIG. 2) to prevent interference between neighboring shoes 12, 14 adjacently mounted on perpendicular cross-members of inside corners.

Figure 5:
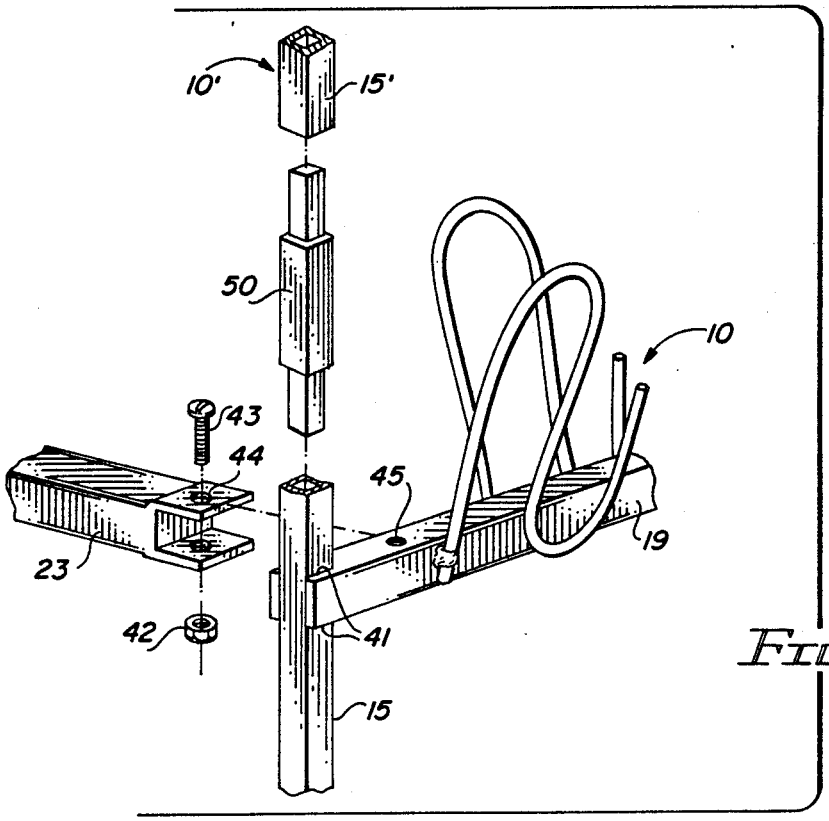
FIG. 5 is an exploded, fragmentary view showing the preferred attachment of a longitudinal cross-member and showing the use of an insert element for stacking, post base-to-post top, identical racks such as those in FIGS. 1-4.

For convenience of packaging, the respective posts 15–18 and laterally extending cross-members 19–22 of the left and right end frames 29, 30 (FIG. 4) are preferably permanently connected, by welding (see welds 41 of FIG. 5) or similar mechanisms. The interconnecting, longitudinally extending cross-members 23–28 are preferably affixed between the end frames 29, 30 by removable fasteners, such as nuts 42 and bolts 43 joined through aligned bores 44, 45 (FIG. 5) to connect corresponding points along the oppositely-positioned cross-members 19–22 (FIG. 5). Thus, the unassembled rack 10 may be stored and shipped in a package size having a maximum dimension determined by the width and length of one end frame 29, 30. Such construction also permits the size of the rack 10 to be conveniently varied by substituting longitudinal cross-members of different length for the already discussed cross-members 23–28. FIG. 4 illustrates the substitution of a one-half length cross-member 25' having two loops 36 per side for the cross-member 25. Similar substitution of one-half length cross-members for the other longitudinal cross-members 23, 24, 26, 27 and 28 provides a rack one-half as deep as the rack 10 of FIG. 1 and which can accommodate 32 pairs of shoes 12, 14.

Figure 2:
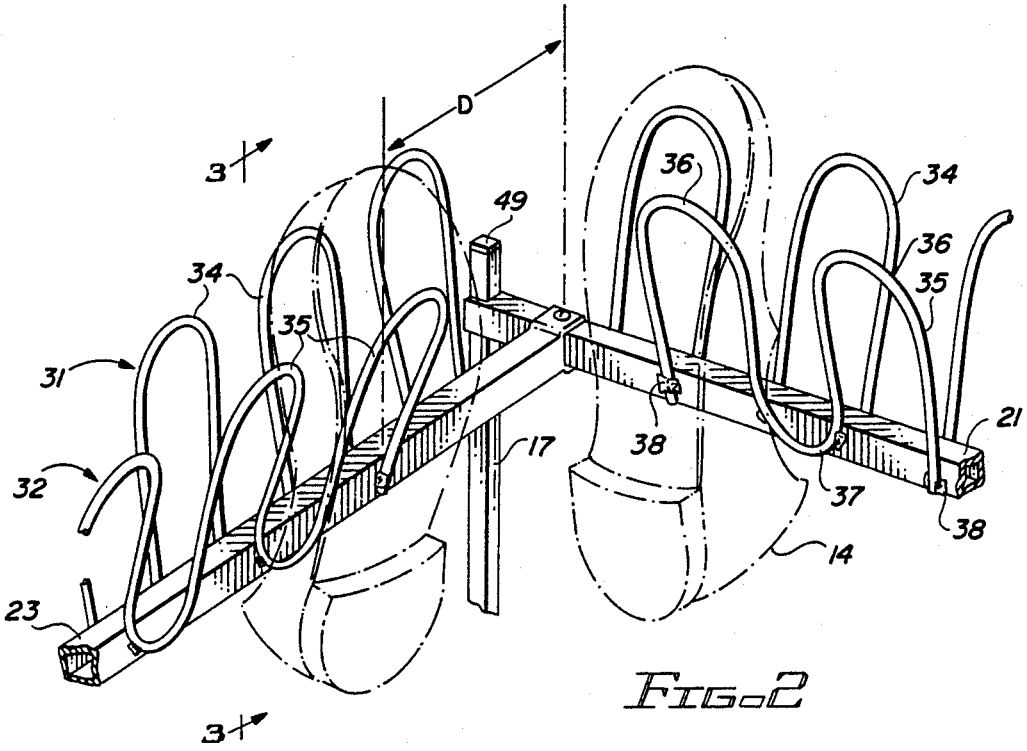
FIG. 2 is an enlarged, fragmentary view of an inside corner portion of the rack of FIG. 1.

The posts 15–18, as already stated, are preferably formed of hollow tubular material. The bases thereof may optionally be provided with swivel casters 48 at each corner to improve transportability of the filled or unfilled rack. The open tops of each post 15–18 can be conveniently closed with plastic caps 49 (FIG. 2). Such configuration permits the caps 49 to be removed and replaced by adapter inserts 50 shown in FIG. 5 which, if placed in the tops of each post 15–18 of a rack 10, can act as intermediaries for receiving the hollow bases of the like posts (see post 15' in FIG. 5) of an identical rack 10' placed above the rack 10. This enables identical racks to be stacked in multi-level configuration, post base-to-post top, thereby multiplying the shoe holding capacity of the arrangement.

It will be appreciated by those skilled in the art to which the invention relates that various substitutions and modifications can be made to the described embodiment without departing from the spirit and scope of the invention as described by the claims below.

What is claimed is:

1. A rack for supporting footwear and similar hollowed articles in closely-packed, compact arrangement, comprising:

an open box-like skeletal framework having an interior and an exterior; said framework including first and second opposing, longitudinally-spaced pairs of upright, laterally-spaced posts; upper and lower elongated cross-members extending laterally at different elevations between said posts of the same post pair; upper and lower elongated cross-members extending longitudinally at different elevations between corresponding ones of said posts of said first and second pairs; first and second pluralities of hangers arranged in opposing parallel, axially-extending rows along each of said cross-members, said hangers of said first plurality being dimensioned, configured and adapted to support footwear in general vertical orientation interiorly of said framework and said hangers of said second plurality being dimensioned, configured and adapted to support footwear in general vertical orientation exteriorly of said framework, so that footwear can be removably supported in opposing parallel rows both interiorly and exteriorly simultaneously at each elevation around the entire periphery of said framework.

2. A rack as in claim 1 for supporting footwear having a toe-receiving hollow, wherein said hangers comprise inverted U-shaped, upwardly projecting elements dimensioned, configured and adapted for supporting footwear thereon by extending into the toe-receiving hollow of said footwear.

3. A rack as in claim 2, wherein each of said pluralities of hangers is formed by a length of wire bent into a corrugated succession of U-shaped loops, with alternating ones of said loops normally projecting upwardly and other connecting ones of said loops between said alternating loops normally extending downwardly and having permanent connections to said cross-members.

4. A rack as in claim 2, wherein said hangers of said first plurality are angled inwardly at an angle of less than 45° relative to vertical and said hangers of said second plurality are angled outwardly at an angle of less than 45° relative to vertical.

5. A rack as in claim 4, wherein adjacent ones of said laterally extending and longitudinally extending cross-members of the same elevation define internal corners, and wherein said upwardly projecting elements of said second pluralities of hangers of said adjacent ones of said cross-members are indented at said internal corners relative to corresponding elements of said first pluralities, whereby interference of footwear placed interiorly of said framework is avoided.

6. A rack as in claim 1, wherein adjacent ones of said laterally extending and longitudinally extending cross-members define internal corners, and said second pluralities of hangers of said ones of said cross-members are indented at said internal corners to prevent interference of neighboring footwear placed interiorly of said framework at said corners.

7. A rack as in claim 1, wherein said posts comprise hollow tubular structures having terminal upper and lower ends, and said rack further comprises means dimensioned, configured and adapted for selective insertion into said upper terminal ends of said tubular structures and for mating identical lower terminal ends of an identical rack to form a stacked, multi-level arrangement.

8. A rack as in claim 1, further comprising casters mounted at a lower end of each post.

9. A rack for supporting footwear and similar hollowed articles in closely-packed, compact arrangement comprising:

an open, box-like skeletal framework having an interior and an exterior; said framework including first and second longitudinally spaced opposing generally planar rectangular end frames, each end frame comprising first and second upright, lateral-spaced corner posts having upper and lower terminal ends, upper and lower elongated cross-members extending laterally and generally horizontally at different elevations between said posts; upper and lower elongated cross-members extending longitudinally and generally horizontally at different elevations between corresponding parts of said end frames; and first and second opposing parallel rows of inverted U-shaped hangers extending axially along each cross-member, said hangers being dimensioned, configured and adapted to support footwear in parallel rows in general vertical orientation respectively interiorly and exteriorly of said framework.

10. A rack as in claim 9, wherein said laterally extending cross-members are permanently joined to said posts, and said rack further comprises means releasably joining said longitudinally extending cross-members to said corresponding posts.

11. A rack as in claim 10, wherein said cross-members have interior and exterior sides, and said first and second rows of hangers extend respectively along said interior and exterior surfaces.

12. A rack as in claim 11, further comprising casters positioned at said lower terminal ends of said posts.

13. A rack as in claim 9, wherein said longitudinally extending cross-members join respective ones of said laterally extending cross-members to define inside corners of said rack, and the hangers of said first row of said cross-members defining said inside corners are indented away from said corners relative to the hangers of said second row of the same cross-members.

14. A rack as in claim 9, wherein the number of said hangers of said first row is fewer than the number of said hangers of said second row for said laterally extending cross-members.

15. A rack as in claim 9, wherein said hangers of said first row are angled inwardly by an angle of less than 45° from vertical and second hangers of said second row are angled outwardly by an angle of less than 45° from vertical.

16. In a rack for supporting footwear including corner posts and cross-members extending between said corner posts and having projecting, inverted U-shaped loop hangers located on said cross-members for receiving footwear in general vertical orientation thereon, said rack having an open box-like form so shoes may be placed interiorly or exteriorly thereof, the improvement comprising:

at least one of said cross-members having first and second pluralities of hangers extending in transversely displaced rows along said cross-members, the first plurality being dimensioned, configured and adapted for supporting footwear in general vertical orientation interiorly of said rack on said at least one cross-member, and the second plurality being dimensioned, configured and adapted for simultaneously supporting footwear exteriorly of said rack on the same said at least one cross-member.

17. The improvement as in claim 16, wherein all of said cross members has like first and second pluralities of hangers.

18. The improvement as in claim 16, wherein said at least one cross-member has a terminal end and an end hanger of said first row of said at least one cross-member is indented from said terminal end relative to a corresponding end hanger of said first row.

19. The improvement as in claim 16, wherein said hangers of said first row are angled inwardly at an angle of less than 45° from vertical, and said hangers of said second row are angled outwardly at an angle of less than 45° from vertical.

20. The improvement as in claim 19, wherein said at least one cross-member has a terminal end and an end hanger of said first row of said at least one cross-member is indented from said terminal end relative to a corresponding end hanger of said first row.

* * * * *